US012408768B2

(12) United States Patent
Frost

(10) Patent No.: US 12,408,768 B2
(45) **Date of Patent: *Sep. 9, 2025**

(54) MODULAR GREETING CARD RACK

(71) Applicant: VANGUARD PACKAGING, LLC, Kansas City, MO (US)

(72) Inventor: Jerry Ryan Frost, Kansas City, MO (US)

(73) Assignee: Vanguard Packaging, LLC, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/861,758

(22) Filed: Jul. 11, 2022

(65) Prior Publication Data

US 2022/0340325 A1 Oct. 27, 2022

Related U.S. Application Data

(63) Continuation of application No. 16/872,308, filed on May 11, 2020, now Pat. No. 11,383,878, which is a (Continued)

(51) Int. Cl.
*A47F 5/11* (2006.01)

(52) U.S. Cl.
CPC ..... *A47F 5/116* (2013.01); *A47F 5/11* (2013.01)

(58) Field of Classification Search
CPC .. A47F 5/116; A47F 5/11; A47F 5/112; A47F 5/0025; A47F 5/0018; A47F 5/118; (Continued)

(56) References Cited

U.S. PATENT DOCUMENTS 235,381 A 12/1880 Rohlfs
2,062,165 A 11/1936 Davidson
(Continued)

FOREIGN PATENT DOCUMENTS

CA 2693596 A1 1/2009
DE 474400 4/1929
(Continued)

OTHER PUBLICATIONS

"Advisory Action Received for U.S. Appl. No. 15/687,791 mailed on Nov. 14, 2019, 4 Pages."
(Continued)

*Primary Examiner* — Hiwot E Tefera
(74) *Attorney, Agent, or Firm* — Kutak Rock LLP

(57) ABSTRACT

A rack display comprising a base having a front panel with a plurality of horizontal and vertical slots included thereon; left and right side panels extending from sides of the front panel; a back panel extending between the left and right side panels; and one or more shelf members including horizontal and vertical tabs. The shelf members are secured to the base by inserting the vertical and horizontal tabs within the vertical and horizontal slots respectively. The rack display is erected from a knockdown configuration by securing the shelf members to the front panel of the base via insertion of the horizontal and vertical tabs within the horizontal and vertical slots respectively.

16 Claims, 9 Drawing Sheets

Related U.S. Application Data continuation of application No. 15/596,381, filed on May 16, 2017, now Pat. No. 10,647,468, which is a continuation of application No. 14/997,685, filed on Jan. 18, 2016, now Pat. No. 9,682,795, which is a continuation of application No. 13/955,925, filed on Jul. 31, 2013, now Pat. No. 9,238,523, said application No. 16/872,308 is a continuation of application No. 16/505,137, filed on Jul. 8, 2019, now Pat. No. 11,013,349, which is a continuation of application No. 15/960,338, filed on Apr. 23, 2018, now Pat. No. 10,342,365, which is a continuation of application No. 13/955,865, filed on Jul. 31, 2013, now Pat. No. 9,949,579, said application No. 16/872,308 is a continuation of application No. 15/952,928, filed on Apr. 13, 2018, now Pat. No. 10,699,602, which is a continuation of application No. 14/679,586, filed on Apr. 6, 2015, now Pat. No. 9,947,245, which is a continuation of application No. 13/955,811, filed on Jul. 31, 2013, now Pat. No. 8,997,388, said application No. 16/872,308 is a continuation of application No. 16/520,270, filed on Jul. 23, 2019, now abandoned, which is a continuation of application No. 15/956,575, filed on Apr. 18, 2018, now Pat. No. 10,390,634, which is a continuation of application No. 15/363,256, filed on Nov. 29, 2016, now Pat. No. 9,986,856, which is a continuation of application No. 14/968,352, filed on Dec. 14, 2015, now Pat. No. 9,578,978, which is a continuation of application No. 14/146,130, filed on Jan. 2, 2014, now Pat. No. 9,212,019, said application No. 16/872,308 is a continuation of application No. 15/912,180, filed on Mar. 5, 2018, now Pat. No. 10,696,450, which is a continuation of application No. 15/369,574, filed on Dec. 5, 2016, now Pat. No. 9,908,663, which is a continuation of application No. 14/216,274, filed on Mar. 17, 2014, now Pat. No. 9,511,899, said application No. 16/872,308 is a continuation of application No. 16/236,920, filed on Dec. 31, 2018, now Pat. No. 10,825,362, which is a continuation of application No. 15/790,692, filed on Oct. 23, 2017, now Pat. No. 10,170,021, which is a continuation of application No. 14/840,417, filed on Aug. 31, 2015, now Pat. No. 9,799,239, which is a continuation of application No. 14/216,721, filed on Mar. 17, 2014, now Pat. No. 9,123,262, said application No. 16/872,308 is a continuation of application No. 15/687,791, filed on Aug. 28, 2017, now Pat. No. 10,687,636, which is a continuation of application No. 14/595,988, filed on Jan. 13, 2015, now Pat. No. 9,743,782.

(60) Provisional application No. 61/677,979, filed on Jul. 31, 2012, provisional application No. 61/677,966, filed on Jul. 31, 2012, provisional application No. 61/677,937, filed on Jul. 31, 2012, provisional application No. 61/748,672, filed on Jan. 3, 2013, provisional application No. 61/793,340, filed on Mar. 15, 2013, provisional application No. 61/791,437, filed on Mar. 15, 2013, provisional application No. 61/926,805, filed on Jan. 13, 2014.

(58) Field of Classification Search

CPC ..... A47F 7/147; A47F 7/145; A47F 5/114; A47F 5/10; A47B 43/02; A47B 55/06; A47B 47/06; A47B 2220/0086; A47B 43/00; A47B 87/0246; A47B 2220/0083; B65D 5/22; B65D 5/5206; B65H 45/12

USPC ..... 211/72, 73, 70.1, 135, 149, 126.16, 211/132.1, 52, 55, 50, 195, 126.12, 59.2, 211/128.1; 40/124.14; 248/174, 152; 206/45.27, 45.25, 736, 175, 176, 193, 206/362.4, 395, 784, 750, 525.1; 312/50, 312/258, 259, 281; 108/165

See application file for complete search history.

(56) References Cited

U.S. PATENT DOCUMENTS

| | | | | | |
|---|---|---|---|---|---|
| 2,115,293 | A | | 4/1938 | Wood | |
| 2,421,225 | A | | 5/1947 | Stensgaard | |
| 2,430,166 | A | * | 11/1947 | Fish | A47F 5/112 211/130.1 |
| 2,578,060 | A | | 12/1951 | Grant | |
| 2,609,136 | A | | 9/1952 | Sider | |
| 2,798,685 | A | | 7/1957 | Mooney | |
| 2,918,178 | A | | 12/1959 | Leone | |
| 3,139,192 | A | | 6/1964 | Maguire | |
| 3,195,734 | A | * | 7/1965 | Paige | A47F 5/112 211/134 |
| 3,195,798 | A | | 7/1965 | Wilson | |
| 3,272,419 | A | | 9/1966 | Vineberg | |
| 3,362,610 | A | | 1/1968 | Dyke | |
| 3,744,700 | A | | 7/1973 | Stegmann | |
| 3,987,737 | A | | 10/1976 | Smith | |
| 4,050,386 | A | | 9/1977 | Kellogg | |
| 4,102,276 | A | | 7/1978 | Roveroni | |
| 4,143,763 | A | | 3/1979 | Haglund | |
| 4,228,904 | A | | 10/1980 | Dumond | |
| 4,248,350 | A | | 2/1981 | Gilbert | |
| 4,306,675 | A | | 12/1981 | Swanson | |
| 4,341,338 | A | | 7/1982 | Arnold | |
| 4,383,636 | A | | 5/1983 | Chaffers | |
| 4,427,108 | A | | 1/1984 | Coles et al. | |
| 4,458,838 | A | | 7/1984 | Lacasa et al. | |
| 4,506,790 | A | | 3/1985 | Muscari | |
| 4,512,541 | A | * | 4/1985 | Lietzke | A47F 5/112 248/459 |
| 4,519,319 | A | | 5/1985 | Howlett | |
| 4,567,996 | A | | 2/1986 | Muise | |
| 4,638,745 | A | | 1/1987 | Sheffer | |
| 4,646,922 | A | | 3/1987 | Smith | |
| 4,709,852 | A | | 12/1987 | Stoll | |
| 4,863,024 | A | | 9/1989 | Booth | |
| 4,871,067 | A | | 10/1989 | Valenti | |
| 4,889,252 | A | | 12/1989 | Rockom et al. | |
| 4,911,355 | A | | 3/1990 | Bannister | |
| 4,932,533 | A | | 6/1990 | Collier | |
| 4,969,595 | A | | 11/1990 | Teasdale | |
| 5,016,545 | A | | 5/1991 | Robertson et al. | |
| 5,068,140 | A | | 11/1991 | Malhotra et al. | |
| 5,145,244 | A | | 9/1992 | Kersting et al. | |
| 5,190,211 | A | | 3/1993 | Stoddard et al. | |
| 5,193,466 | A | | 3/1993 | Eder | |
| 5,213,220 | A | | 5/1993 | McBride | |
| 5,226,571 | A | | 7/1993 | Eastwood et al. | |
| 5,253,769 | A | | 10/1993 | Vlastakis | |
| 5,277,360 | A | | 1/1994 | Demott | |
| 5,301,800 | A | | 4/1994 | Kenney | |
| 5,312,034 | A | | 5/1994 | Nakagawa et al. | |
| 5,315,936 | A | | 5/1994 | Smith | |
| 5,316,210 | A | | 5/1994 | Scullin | |
| D348,000 | S | | 6/1994 | Strasevicz et al. | |
| 5,318,789 | A | | 6/1994 | Nakagawa et al. | |
| 5,322,212 | A | | 6/1994 | Strasevicz et al. | |
| 5,333,777 | A | | 8/1994 | Roth | |
| 5,347,772 | A | | 9/1994 | Ishimaru et al. | |
| D352,235 | S | | 11/1994 | Strasevicz et al. | |
| 5,579,991 | A | | 12/1996 | Strasevicz et al. | |
| 5,702,011 | A | | 12/1997 | Carroll | |
| 5,706,959 | A | | 1/1998 | Smith | |

(56) References Cited

U.S. PATENT DOCUMENTS

| | | | |
|---|---|---|---|
| 5,715,623 | A | 2/1998 | Mackey, III |
| RE35,875 | E | 8/1998 | Shuert |
| 5,826,732 | A | 10/1998 | Ragsdale |
| 5,966,857 | A | 10/1999 | Pettersson et al. |
| 6,068,140 | A | 5/2000 | Mangrum et al. |
| 6,098,820 | A | 8/2000 | Smith |
| 6,126,254 | A | 10/2000 | Maglione |
| 6,155,441 | A | 12/2000 | Andersen et al. |
| 6,168,073 | B1 | 1/2001 | Towle |
| 6,283,363 | B1 | 9/2001 | Focke |
| 6,347,772 | B1 | 2/2002 | L'Hotel |
| 6,378,710 | B1 | 4/2002 | Grueneberg |
| 6,440,050 | B1 | 8/2002 | Capparelli |
| 6,457,421 | B1 | 10/2002 | Apichom |
| 6,508,023 | B2 | 1/2003 | Moss et al. |
| 6,581,772 | B2 | 6/2003 | Noland |
| 6,612,669 | B2 | 9/2003 | Grueneberg |
| 6,715,623 | B2 | 4/2004 | Broerman |
| 7,007,615 | B2 | 3/2006 | Grueneberg |
| 7,066,342 | B2 | 6/2006 | Baechle et al. |
| 7,111,735 | B2 | 9/2006 | Lowry |
| 7,134,230 | B1 | 11/2006 | Boens et al. |
| 7,137,517 | B2 | 11/2006 | Lowry et al. |
| 7,252,200 | B1 | 8/2007 | Hester |
| 7,281,648 | B2 | 10/2007 | Lowry |
| 7,284,662 | B2 | 10/2007 | Debusk et al. |
| 7,546,927 | B2 | 6/2009 | Lowry et al. |
| 7,634,865 | B2 | 12/2009 | L'Hôtel |
| 7,677,433 | B2 | 3/2010 | Little |
| 7,681,735 | B2 | 3/2010 | Youell, Jr. et al. |
| 7,703,864 | B2 | 4/2010 | Moser |
| 7,708,187 | B2 | 5/2010 | Keefe, Jr. et al. |
| 7,753,218 | B2 | 7/2010 | Moss et al. |
| 7,810,707 | B2 | 10/2010 | Little |
| 7,819,305 | B2 | 10/2010 | Little |
| 7,861,916 | B2 | 1/2011 | Little |
| 7,981,017 | B2 | 7/2011 | Little et al. |
| 8,281,981 | B2 | 10/2012 | Foden |
| 8,376,213 | B2 | 2/2013 | Brand |
| 8,459,190 | B2 | 6/2013 | Erdie |
| 8,596,518 | B2 | 12/2013 | Babcock |
| 8,740,054 | B2 | 6/2014 | Pinkstone |
| 8,763,888 | B2 | 7/2014 | Willman et al. |
| 8,997,388 | B1 | 4/2015 | Frost |
| 9,123,262 | B1 | 9/2015 | Frost |
| 9,126,721 | B2 | 9/2015 | Dye et al. |
| 9,212,019 | B2 | 12/2015 | Frost |
| 9,238,523 | B1 | 1/2016 | Frost |
| 9,511,899 | B1 | 12/2016 | Valentini et al. |
| 9,578,978 | B2 | 2/2017 | Frost |
| 9,682,795 | B1 | 6/2017 | Frost |
| 9,743,782 | B1 | 8/2017 | Frost |
| 9,783,333 | B1 | 10/2017 | De Los et al. |
| 9,799,239 | B1 | 10/2017 | Frost |
| 9,908,663 | B1 | 3/2018 | Valentini et al. |
| 9,947,245 | B1 | 4/2018 | Frost |
| 9,949,579 | B1 | 4/2018 | Frost |
| 9,986,856 | B1 | 6/2018 | Frost |
| 9,994,356 | B2 | 6/2018 | Couture |
| 10,081,470 | B2 | 9/2018 | Weaver et al. |
| 10,170,021 | B2 | 1/2019 | Frost |
| 10,329,046 | B2 | 6/2019 | Smith |
| 10,342,365 | B2 | 7/2019 | Frost |
| 10,390,634 | B2 | 8/2019 | Frost |
| 10,472,123 | B2 | 11/2019 | Little |
| 10,513,368 | B2 | 12/2019 | Iwahara et al. |
| 10,647,468 | B2 | 5/2020 | Jerry |
| 10,687,636 | B2 | 6/2020 | Frost |
| 10,696,450 | B2 | 6/2020 | Valentini et al. |
| 10,699,602 | B2 | 6/2020 | Frost |
| 10,825,362 | B2 | 11/2020 | Frost |
| 10,919,677 | B2 | 2/2021 | Chevalier |
| 11,383,878 | B2 | 7/2022 | Frost |
| 11,589,689 | B2 * | 2/2023 | McGill ..... A47F 7/146 |
| 2002/0108541 | A1 | 8/2002 | Grueneberg |
| 2003/0160015 | A1 | 8/2003 | Broerman |
| 2004/0118742 | A1 | 6/2004 | Shuert |
| 2005/0067321 | A1 | 3/2005 | Pitts et al. |
| 2006/0157380 | A1 | 7/2006 | Lowry et al. |
| 2006/0213851 | A1 | 9/2006 | Grueneberg |
| 2007/0095767 | A1 | 5/2007 | Henke et al. |
| 2007/0235396 | A1 | 10/2007 | Moss et al. |
| 2008/0030113 | A1 | 2/2008 | Vail |
| 2008/0067301 | A1 | 3/2008 | Moss |
| 2008/0083682 | A1 | 4/2008 | Moss et al. |
| 2008/0169340 | A1 | 7/2008 | Sheffer |
| 2009/0119956 | A1 | 5/2009 | Martin Presa |
| 2009/0140118 | A1 | 6/2009 | Moss et al. |
| 2009/0286663 | A1 | 11/2009 | Little et al. |
| 2010/0006629 | A1 | 1/2010 | Bettinger et al. |
| 2010/0083618 | A1 | 4/2010 | Little |
| 2010/0087304 | A1 | 4/2010 | Little |
| 2010/0108748 | A1 | 5/2010 | Fleming et al. |
| 2010/0234201 | A1 | 9/2010 | Little et al. |
| 2010/0236117 | A1 | 9/2010 | Mestres Armengol et al. |
| 2011/0011922 | A1 | 1/2011 | Little |
| 2011/0088300 | A1 | 4/2011 | Martin Presa |
| 2012/0012734 | A1 | 1/2012 | Tzuo |
| 2012/0227297 | A1 | 9/2012 | Kawaguchi et al. |
| 2012/0267284 | A1 | 10/2012 | Thimmesch et al. |
| 2013/0026060 | A1 | 1/2013 | Moss et al. |
| 2013/0192110 | A1 | 8/2013 | Da Fonseca et al. |
| 2013/0213915 | A1 | 8/2013 | Pfeifer et al. |
| 2013/0219760 | A1 | 8/2013 | Acker et al. |
| 2013/0284799 | A1 | 10/2013 | Hallam et al. |
| 2014/0061288 | A1 | 3/2014 | Dashe |
| 2016/0075465 | A1 | 3/2016 | Wiley |
| 2016/0144994 | A1 | 5/2016 | Flaming |
| 2017/0217633 | A1 | 8/2017 | Lundius |
| 2017/0247136 | A1 | 8/2017 | Frost |
| 2017/0354272 | A1 | 12/2017 | Frost |
| 2018/0127148 | A1 | 5/2018 | Kuhn et al. |
| 2018/0194515 | A1 | 7/2018 | Valentini et al. |
| 2018/0229917 | A1 | 8/2018 | Jobe |
| 2018/0233070 | A1 | 8/2018 | Frost |
| 2018/0235381 | A1 | 8/2018 | Frost |
| 2019/0112095 | A1 | 4/2019 | Swarnaraj et al. |
| 2019/0139460 | A1 | 5/2019 | Frost |
| 2019/0343301 | A1 | 11/2019 | Frost |
| 2020/0270014 | A1 | 8/2020 | Frost |

FOREIGN PATENT DOCUMENTS

| | | | | |
|---|---|---|---|---|
| DE | 3824930 | A1 | 1/1990 | |
| DE | 3924930 | A1 | 2/1990 | |
| DE | 102007055301 | A1 * | 5/2009 | ..... A47F 5/116 |
| DE | 202011002250 | U1 * | 6/2011 | ..... A47F 5/116 |
| FR | 2380129 | A1 | 9/1978 | |
| FR | 2794351 | A1 * | 12/2000 | ..... A47F 5/114 |
| GB | 1188834 | A | 4/1970 | |

OTHER PUBLICATIONS

"Advisory Action Received for U.S. Appl. No. 15/687,791 mailed on Oct. 28, 2019, 4 Pages."
"English translation of FR 2380129 A1 Dated Sep. 8, 1978".
"Final Office Action received for U.S. Appl. No. 15/596,381, mailed on Mar. 15, 2018".
"Final Office Action Received for U.S. Appl. No. 15/960,338, mailed on Jan. 31, 2019, 6 pages".
"Final Office Action received for U.S. Appl. No. 13/955,865, mailed on Jul. 29, 2014".
"Final Office Action Received for U.S. Appl. No. 15/596,381 on Jul. 15, 2019, pp. 8."
"Final Office Action received for U.S. Appl. No. 15/687,791, mailed on Aug. 8, 2019, 15 Pages", 15.
"Final Office Action received for U.S. Appl. No. 15/952,928 on Feb. 28, 2020, pp. 07."
"Final Office Action Received for U.S. Appl. No. 15/956,575 mailed on Jan. 4, 2019, 10 Pages."
"Final office action received for U.S. Appl. No. 13/955,925 dated Jul. 15, 2015".

(56) References Cited

OTHER PUBLICATIONS

"Final Office Action received for U.S. Appl. No. 14/146,130 dated Apr. 30, 2015, 11 pages".
"Final Office Action received for U.S. Appl. No. 14/968,352 dated Jul. 29, 2016, 14 pages".
"Final Office Action received for U.S. Appl. No. 15/363,256 dated Jul. 3, 2017, 17 pages".
"Final Office Action received for U.S. Appl. No. 16/520,270, Mailed on Apr. 21, 2020, 14 Pages".
"Final Rejection Received for U.S. Appl. No. 14/679,586 mailed on Apr. 6, 2017, 12 Pages", 12.
"Non Final Office Action Received for U.S. Appl. No. 15/687,791 mailed on Jan. 2, 2019, 20 Pages."
"Non Final Office Action Received for U.S. Appl. No. 15/952,928 mailed on Jul. 18, 2019, 20 Pages."
"Non Final Office Action received for U.S. Appl. No. 15/956,575, mailed on May 31, 2018, 10 pages".
"Non Final Office Action received for U.S. Appl. No. 15/960,338, mailed on Jun. 28, 2018, 15 pages".
"Non Final Office Action Received for U.S. Appl. No. 16/520,270, mailed on Aug. 22, 2019, 28 Pages."
"Non-Final Office Action received for U.S. Appl. No. 16/236,920, Mailed on Jan. 3, 2020, 6 Pages".
"Non-Final Office Action Received for U.S. Appl. No. 15/596,381 mailed on Sep. 14, 2017".
"Non-Final Office Action received for U.S. Appl. No. 13/955,865, mailed on Oct. 1, 2013".
"Non-Final Office Action received for U.S. Appl. No. 14/216,721, mailed on Nov. 26, 2014 10 pages."
"Non-Final Office Action received for U.S. Appl. No. 14/840,417, mailed on Dec. 21, 2016 8 pages."
"Non-Final Office Action Received for U.S. Appl. No. 15/596,381 mailed on Oct. 10, 2018".
"Non-Final Office Action received for U.S. Appl. No. 15/790,692, mailed on Jan. 22, 2018", 7.
"Non-Final Office Action Received for U.S. Appl. No. 16/872,308, mailed on Jul. 16, 2021".
"Non-Final office action received for U.S. Appl. No. 13/955,811 dated Jul. 9, 2014, 9 pages", 9.
"Non-Final office action received for U.S. Appl. No. 13/955,925 dated Oct. 7, 2014".
"Non-Final office action received for U.S. Appl. No. 14/216,274 dated Jun. 17, 2016".
"Non-Final office action received for U.S. Appl. No. 14/679,586 dated Aug. 19, 2016, 16 Pages", 16.
"Non-Final office action received for U.S. Appl. No. 14/595,988 dated Apr. 20, 2016,9 Pages".
"Non-Final Office Action received for U.S. Appl. No. 14/146,130 dated Sep. 2, 2014, 8 pages".
"Non-Final Office Action received for U.S. Appl. No. 14/968,352 dated Jan. 11, 2016, 13 pages".
"Non-Final Office Action received for U.S. Appl. No. 15/363,256 dated Dec. 16, 2016, 15 pages".
"Notice of Allowance received for U.S. Appl. No. 15/687,791, Mailed on Mar. 9, 2020, 5 pages".
"Notice of Allowance received for U.S. Appl. No. 14/216,721, mailed on Apr. 23, 2015 6 pages."
"Notice of Allowance received for U.S. Appl. No. 14/840,417, mailed on Jun. 19. 2017, 7 Pages".
"Notice of Allowance received for U.S. Appl. No. 16/236,920, mailed on Jul. 22, 2020."
"Notice of Allowance Received for U.S. Appl. No. 15/912,180 , Mailed on Mar. 19, 2020.".
"Notice of Allowance Received for U.S. Appl. No. 13/955,865, Mailed on Dec. 13, 2017."
"Notice of Allowance Received for U.S. Appl. No. 14/595,988 mailed on Apr. 24, 2017, 12 Pages".
"Notice of Allowance Received for U.S. Appl. No. 14/997,685 mailed on Feb. 17, 2017".
"Notice of Allowance Received for U.S. Appl. No. 15/363,256 mailed on Nov. 30, 2017".
"Notice of Allowance Received for U.S. Appl. No. 15/369,574 , Mailed on Oct. 24, 2017."
"Notice of Allowance Received for U.S. Appl. No. 15/790,692, Mailed on Aug. 24, 2018,8 Pages".
"Notice of Allowance Received for U.S. Appl. No. 16/872,308, mailed on Dec. 7, 2021."
"Notice of Allowance Received for U.S. Appl. No. 16/872,308, mailed on Mar. 2, 2022."

* cited by examiner

MODULAR GREETING CARD RACK

CROSS-REFERENCE TO RELATED APPLICATIONS

This application is a continuation of U.S. patent application Ser. No. 16/872,308, filed May 11, 2020, which is a continuation-in-part application of the following:

- U.S. patent application Ser. No. 15/596,381, filed May 16, 2017, now U.S. Pat. No. 10,647,468, which is a continuation application of U.S. patent application Ser. No. 14/997,685, filed Jan. 18, 2016, now U.S. Pat. No. 9,682,795, which is a continuation application of U.S. patent application Ser. No. 13/955,925, filed Jul. 31, 2013, now U.S. Pat. No. 9,238,523, which claims priority benefit, with regard to all common subject matter, of earlier-filed U.S. Provisional Patent Application No. 61/677,979, filed Jul. 31, 2012, and entitled "IMPROVED STACKABLE TRAY," the entire disclosures of which are incorporated herein by reference.
- U.S. patent application Ser. No. 16/505,137, filed on Jul. 8, 2019, which is a continuation application of U.S. patent application Ser. No. 15/960,338, filed Apr. 23, 2018, now U.S. Pat. No. 10,342,365, which is a continuation application of U.S. patent application Ser. No. 13/955,865, filed Jul. 31, 2013, now U.S. Pat. No. 9,949,579, which claims priority benefit, with regard to all common subject matter, of earlier-filed U.S. Provisional Patent Application No. 61/677,966, filed Jul. 31, 2012, and entitled "TRIFEED HUTCH SHELF," the entire disclosures of which are incorporated herein by reference.
- U.S. patent application Ser. No. 15/952,928, filed Apr. 13, 2018, which is a continuation application of U.S. patent application Ser. No. 14/679,586, filed Apr. 6, 2015, now U.S. Pat. No. 9,947,245, which is a continuation application of U.S. patent application Ser. No. 13/955,811, filed Jul. 31, 2013, now U.S. Pat. No. 8,997,388, which claims priority benefit, with regard to all common subject matter, of earlier-filed U.S. Provisional Patent Application No. 61/677,937, filed Jul. 31, 2012, and entitled "FACETED CORRUGATED SIGNAGE," the entire disclosures of which are incorporated herein by reference.
- U.S. patent application Ser. No. 16,520,270, filed Jul. 23, 2019, which is a continuation application of U.S. patent application Ser. No. 15/956,575, filed Apr. 18, 2018, now U.S. Pat. No. 10,390,634, which is a continuation application of U.S. patent application Ser. No. 15/363,256, filed Nov. 29, 2016, now U.S. Pat. No. 9,986,856, which is a continuation application of U.S. patent application Ser. No. 14/968,352, filed Dec. 14, 2015, now U.S. Pat. No. 9,578,978, which is a continuation application of U.S. patent application Ser. No. 14/146,130, filed Jan. 2, 2014, now U.S. Pat. No. 9,212,019, which claims priority benefit, with regard to all common subject matter, of earlier-filed U.S. Provisional Patent Application No. 61/748,672, filed Jan. 3, 2013, and entitled "MODULAR GREETING CARD RACK," the entire disclosures of which are incorporated herein by reference.
- U.S. patent application Ser. No. 15/912,180, filed Mar. 5, 2018, which is a continuation application of U.S. patent application Ser. No. 15/369,574, filed Dec. 5, 2016, now U.S. Pat. No. 9,908,663, which is a continuation application of U.S. patent application Ser. No. 14/216,274, filed Mar. 17, 2014, now U.S. Pat. No. 9,511,899, which claims priority benefit, with regard to all common subject matter, of earlier-filed U.S. Provisional Patent Application No. 61/793,340, filed Mar. 15, 2013, and entitled "ONE PIECE PALLET SKIRT," the entire disclosures of which are incorporated herein by reference.
- U.S. patent application Ser. No. 16/236,920, filed Dec. 31, 2018, which is a continuation application of U.S. patent application Ser. No. 15/790,692, filed Oct. 23, 2017, now U.S. Pat. No. 10,170,021, which is a continuation application of U.S. patent application Ser. No. 14/840,417, filed Aug. 31, 2015, now U.S. Pat. No. 9,799,239, which is a continuation application of U.S. patent application Ser. No. 14/216,721, filed Mar. 17, 2014, now U.S. Pat. No. 9,123,262, which claims priority benefit, with regard to all common subject matter, of earlier-filed U.S. Provisional Patent Application No. 61/791,437, filed Mar. 15, 2013, and entitled "FACETED CORRUGATED SIGNAGE," the entire disclosures of which are incorporated herein by reference.
- U.S. patent application Ser. No. 15/687,791, filed Aug. 28, 2017, which is a continuation application of U.S. patent application Ser. No. 14/595,988, filed Jan. 13, 2015, now U.S. Pat. No. 9,743,782, which claims priority benefit, with regard to all common subject matter, of earlier-filed U.S. Provisional Patent Application No. 61/926,805, filed Jan. 13, 2014, and entitled "RETAIL UPRIGHT SHELF EXTENDER," the entire disclosures of which are incorporated herein by reference.

FIELD OF THE INVENTION

Embodiments of the present invention relate generally to the field of point of purchase merchandise shipping and display containers. More particularly, embodiments of the present invention relate to a corrugated, paperboard container and display that is manufactured in a fold and glue assembly process and that is traditionally provided to an end user in a collapsed or knockdown configuration for setup.

BACKGROUND

Corrugated displays and containers are often made from pieces of flat paperboard stock material that are die cut into shapes that define various panels. The shapes are folded along predefined lines between the panels with at least one overlapping strip or panel that is glued, taped or otherwise affixed to another panel to form an enclosed boundary. The panels are folded and/or glued into place to become the walls of the display or container. The displays or containers are traditionally provided to product manufacturers and/or retailers in a collapsed or knock-down configuration for storage, handling and shipping. The manufacturer and/or retailers open the knockdown containers and fold appropriately to utilize the assembled display or container for display and/or packing products therein.

The knockdown displays or containers are typically manufactured by feeding flat die cut sheets through a fold-and-glue machine. The fold-and-glue machine applies adhesive and folds over select panels so that the panels are in the knockdown configuration. One common knockdown display is a multi-shelved greeting card rack style display. A corrugated card rack display is typically used to display products, such as greeting cards, to consumers at a point-of-sale location. It is desirable to minimize the time and effort necessary to manufacture the card rack display and to erect the display from its knockdown configuration. Conventional, corrugated card rack displays often include shelves made using a single sheet of corrugated that "accordions" to make multiple shelves. This adds considerably to assembly labor and time as well as to material and labor costs for manufacturing the container. Thus, it would be beneficial to provide a card rack style display that reduces labor and material costs.

SUMMARY

Embodiments of the present invention include a rack display comprising a base having a front panel with a plurality of horizontal and vertical slots included thereon; left and right side panels extending from sides of the front panel; a back panel extending between the left and right side panels; and one or more shelf members including horizontal and vertical tabs. The shelf members are secured to the base by inserting the vertical and horizontal tabs within the vertical and horizontal slots respectively.

Embodiments of the present invention also include a method of making a rack display, which includes the steps of: forming a base that includes a front panel opposed by left and right side panels, and a back panel extending from between the side panels; forming a fold line between each adjacent panel of the base; forming one or more horizontal slots and one or more vertical slots through a thickness of the front panel; and forming one or more shelf members that are capable of being secured to the front panel of the base, with each of the shelf members including horizontal and vertical tabs. In such a method, the horizontal tabs are configured to be inserted within the horizontal slots and the vertical tabs are configured to be inserted within the vertical slots.

Embodiments of the present invention additionally include a method of erecting a rack display, which includes the initial step of providing the rack display in a knockdown configuration, with the rack display including a base having a front panel opposed by left and right side panels, and left and right back panels extending from the left and right side panels respectively. The front panel includes one or more horizontal slots and one or more vertical slots. Furthermore, the rack display further includes one or more shelf members, with the shelf members having one or more horizontal tabs and one or more vertical tabs. The method additionally includes the steps of: folding the left and right side panels until the side panels are not coplanar with the front panel; folding the left and right back panels until the back panels are not coplanar with the side panels; securing edges of the left and right back panels together; inserting the horizontal tabs of the shelf members within the horizontal slots of the front panel; and inserting the vertical tabs of the shelf members within the vertical slots of the front panel.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION

Embodiments of the present invention are described in detail below with reference to the attached drawing figures, wherein.

Figure 1:
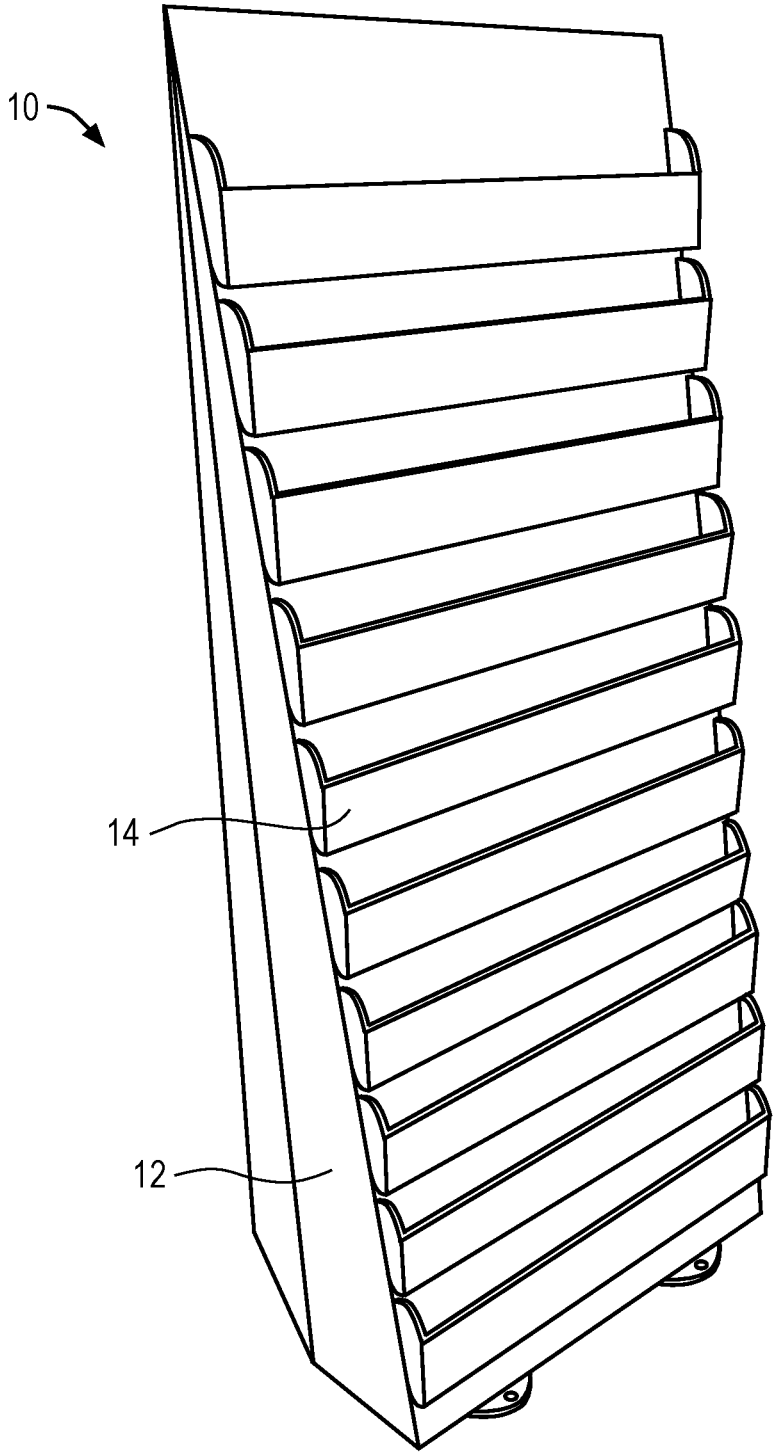
FIG. 1 is a perspective view of a rack display according to embodiments of the present invention, with the rack display including a base and a plurality of shelf members.

APPENDIX A includes a copy of one issued patent from each of the seven patent families associated with this continuation-in-part application.

The drawing figures do not limit the present invention to the specific embodiments disclosed and described herein. The drawings are not necessarily to scale, emphasis instead being placed upon illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

As used herein, direction or relational terms such as "front," "back," "left," "right," "top," and "bottom" are used as an aid to the reader in place of less visual terms such as "first" and "second." Such terms are used in the context of a user viewing embodiments of the present invention from a front view. Similarly, the term "longitudinal" generally refers to an orientation or direction relative to an axis of elongation, whereas "lateral" refers to an orientation or direction that is generally perpendicular to the axis of elongation.

Figure 2:
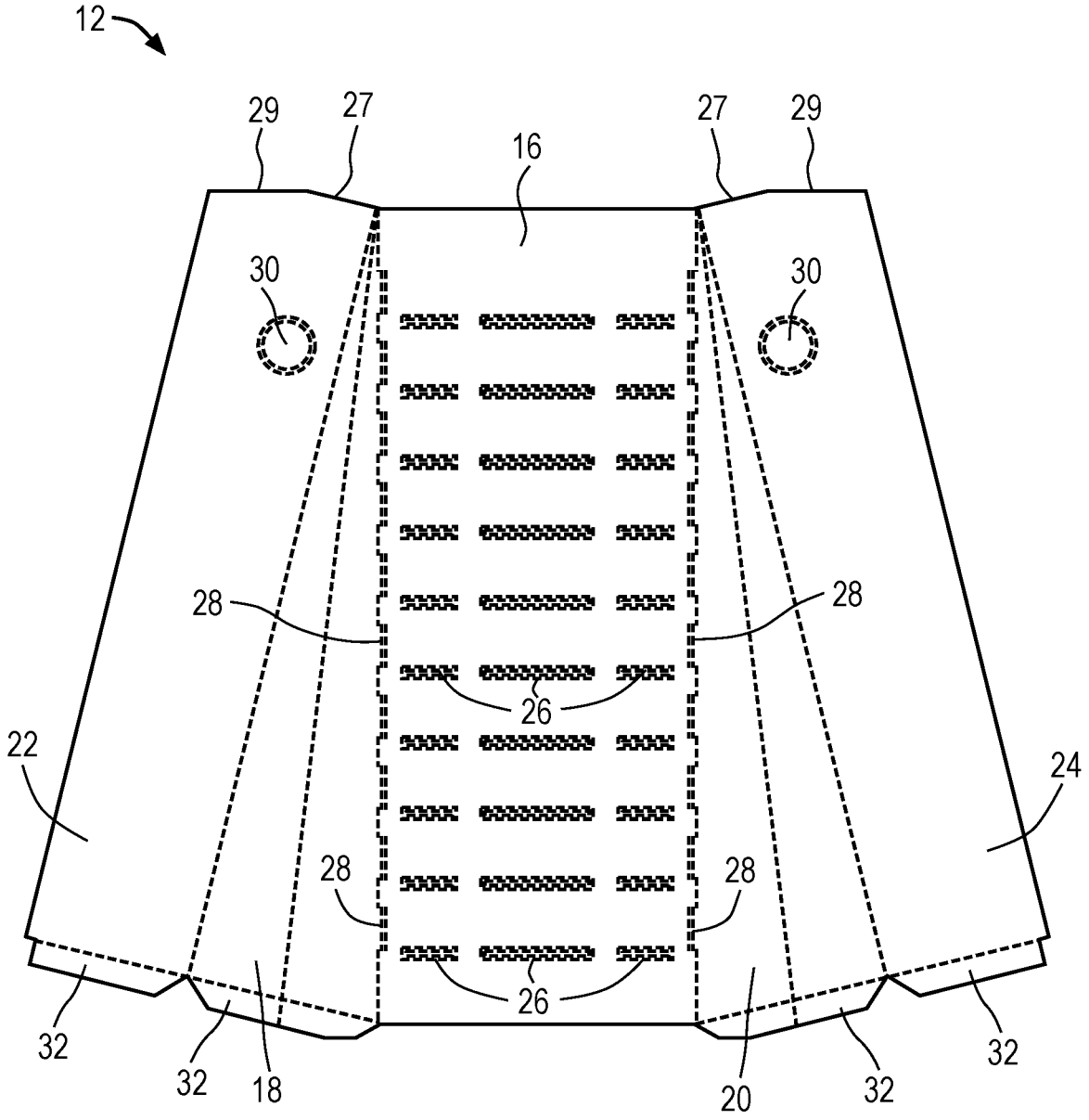
FIG. 2 is a plan view of the base of the rack display from FIG. 1.
Figure 3:
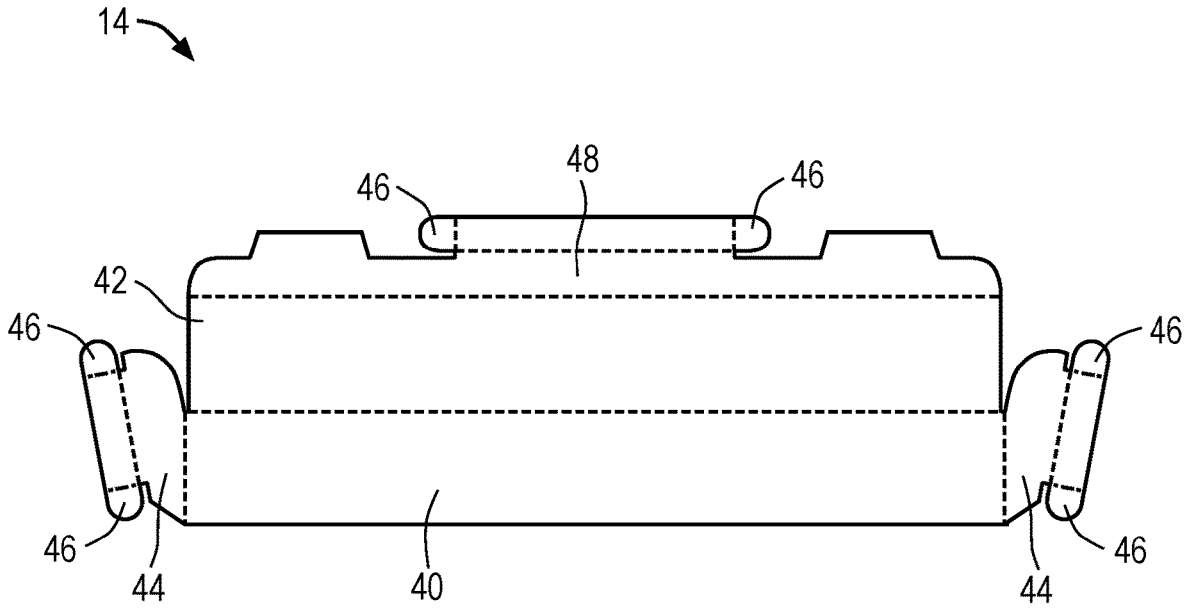
FIG. 3 is a plan view of a shelf member from the plurality of shelf members of the rack from FIG. 1.

As shown in FIG. 1, embodiments of the present invention include a rack display 10 that includes a base 12 and one or more shelf members 14 secured to the base for accommodating and displaying products such as, for instance, cards, magazines, books, or the like. In certain embodiments, the rack display 10 is formed from corrugated material, such as paperboard. However, other embodiments provide for the corrugated material to include other similar type materials, such as cardboard, fiberboard, or the like. The rack display 10, including the base 12 and the shelf members 14, is operable to be provided in a knockdown configuration (i.e., a generally flat, two-dimensional form), such as illustrated in FIGS. 2-3. From the knockdown configuration, the rack display 10 is operable to be transformed into an erected configuration, such as shown in FIG. 1.

With reference to FIG. 2, the base 12 of the rack display 10 of embodiments of the present invention comprises a front panel 16 opposed by left and right side panels 18,20, a left back panel 22 extending from the left side panel; and a right back panel 24 extending from the right side panel panel. In certain embodiments, the front panel 16 is generally a rectangular shaped panel. However, it is understood that other embodiments provide for the front panel 16 to be formed in other shapes without departing from the scope of the present invention. The front panel 16 includes a plurality of rows of horizontal slots 26. In certain embodiments, the front panel 16 has three horizontal slots 26 in each row. However, other embodiments provide for more or less than three horizontal slots 26 in each row. As will be discussed in more detail below, the horizontal slots 26 are used to receive portions of the shelf members 14 to secure the shelf members to the base 12. In addition to the horizontal slots 26, in some embodiments, the front panel 16 includes a plurality of vertical slots 28. In certain embodiments, the front panel 16 includes two vertical slots 28 aligned slightly above each row of horizontal slots 26 and positioned to left and rights of the rows. As with the horizontal slots 26, the vertical slots 28 are used to receive portions of the shelf members 14 to secure the shelf members to the base 12.

In some embodiments, the left and right side panels 18, 20 of the base 12 extend laterally from sides of the front panel 16. The side panels 18, 20 are separated from the front panel 16 via fold lines, which are weakened areas of the corrugated material that allow for the side panels to rotate or fold with respect to the front panel. For example, to create such fold lines in certain embodiments, the corrugated material comprising the rack display 10 is compressed along a thin line defining a fold line. In other embodiments, the corrugated material is cut part way through along the line, or alternatively, cut all or part way through the line at spaced intervals. In some embodiments, each of the side panels 18, 20 are generally shaped in the form of a triangle, such that a width of the side panels is greater at a base of the side panels than at a top of the side panels. However, it is understood that other embodiments of the present invention provide for the side panels 18, 20 to be formed in shapes other than triangles, such as rectangle, squares, circles, ovals, or the like. In certain embodiments, the side panels 18, 20 are longitudinally bisected by a fold line. As such, the side panels 18, 20 are capable of folding about themselves, so as to allow for the rack display to be collapsible, as will be discussed in more detail below.

In certain embodiments, the left and right back panels 22, 24 of the base 12 extend laterally from sides of the left and right side panels 18, 20 respectively. The back panels 22, 24 are separated from the side panels 18, 20 respectively via fold lines. As such, the back panels 22, 24 are capable of respectively rotating or folding with respect to the side panels 18,20. In some embodiments, the back panels 22, 24 are generally rectangular in shape. However, it is understood that in other embodiments, the back panels 22, 24 are formed in other shapes without departing from the scope of the present invention. For instance, certain embodiments provide for a top edge of each of the back panels 22, 24 to have an angled portion 27 that is angled upward from an upper corner of the front panel 16. The angled portion 27 extends along a portion of the back panels' 22, 24 width. Certain embodiments further provide for a remaining horizontal portion 29 of the top edge of each of the back panels 22, 24 to be generally horizontal and extend from the angled portion 27 to a side edge of the back panels. As such, the angled portion 27 allows for the horizontal portion 29 to be generally flush with a top edge of the front panel 16 when the base 12 is erected, as will be discussed in more detail below. In the embodiment shown in FIG. 2, the angle and length of the angled portion 27 is illustrated for exemplary purposes. It will be appreciated that in alternative embodiments other angles and/or lengths are utilized, and in some other embodiments, the entire top edge of the back panels 22, 24 is made to be flush with the top of the front panel 16.

In certain embodiments of the present invention, the back panels 22, 24 each include an opening 30, such as a hole formed through a thickness of the back panels, extending through an upper portion of the back panels. In certain embodiments, the openings 30 function as handles for a user to lift and/or carry the rack display 10. In additional embodiments, the openings 30 allow for access to the interior of the base 12 to aid in assembling rack display 10 and/or securing the shelve members 14 to the base 12, as will be discussed in more detail below.

In certain embodiments, such as the embodiment shown in FIG. 2, one or more the various panels (i.e., front, side, and back panels) of the base 12 include bottom support tabs 32 that extend from a bottom edge of the panels. The bottom support tabs 32 are separated from the panels via fold lines, such that the support tabs are free to rotate or fold with respect to the panels. As such, the bottom support tabs 32 are capable of being folded orthogonally with respect to the panels and thus used to provide stability to the rack display 10 when the rack display is in an erected configuration and positioned on a ground surface, as will be discussed in more detail below.

Turning to FIG. 3, which illustrates the exemplary shelf member 14. The shelf member 14 includes an outer panel 40 separated by a fold line from an inner panel 42. The outer panel 40 includes side panels 44 that extend from sides of the outer panel 40 and that are separated from the outer panel via fold lines. In certain embodiments, the side panels 44 include tabs with tab fingers 46 that extend from sides of the side tabs and that are capable of folding about the tabs via fold lines. As will be discussed in more detail below, the tab fingers 46 are used to provide additional support and securement for the shelf members 14 as they are attached to the base 12. In certain embodiments, the shelf members 14 additionally include a tab panel 48 that extends from the inner panel 42 and that is separated from the inner panel 42 via a fold line. In some embodiments, the tab panel 48 has one or more tabs extending therefrom. In certain embodiments, the tab panel 48 has three tabs extending therefrom.

However, other embodiments provide for the tab section 48 to have more or less than three tabs. In certain embodiments of the present invention, the number of tabs of the tab panel 48 corresponds to the number of horizontal slots 26 on a row of horizontal slots 26 on the front panel 16 of the base 12. In even further embodiments, one or more of the tabs of the tab section 48 include tab fingers 46 that extend from sides of the tabs and are capable of folding with respect to the tabs.

Figure 4:
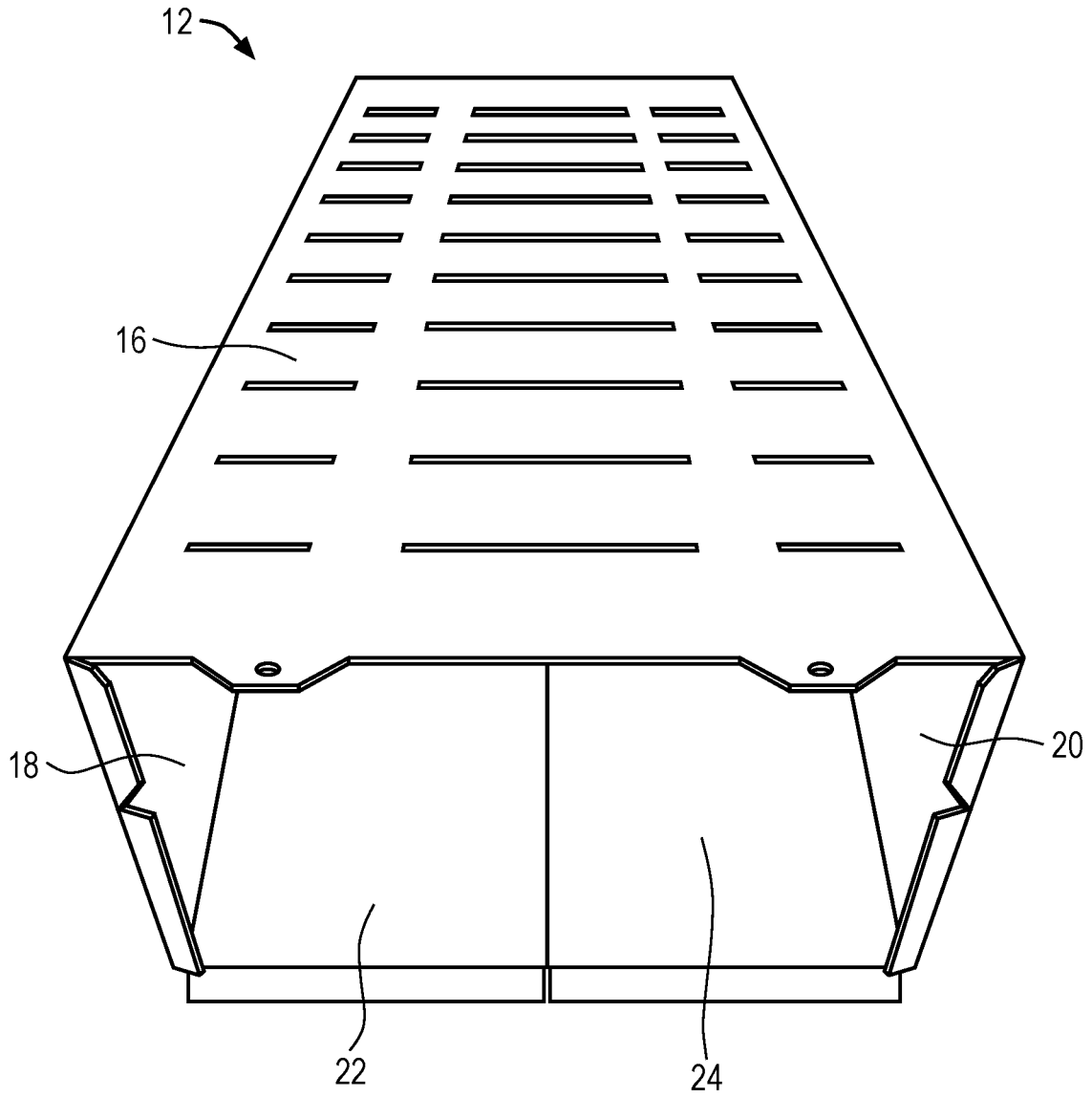
FIG. 4 is a bottom perspective view of the base from FIG. 2 in an erected configuration.

In operation, the rack display 10 is capable of being transformed in a simple and quick manner from the knockdown configuration of FIGS. 2-3 to the erected configuration illustrated in FIG. 1. To begin, and with reference to FIG. 4, the left and right side panels 18,20 are folded about the fold lines separating the side panels from the front panel 16 until the side panels are generally orthogonal to and behind the front panel. Next, the left and right back panels 22, 24 of the base 12 are folded along the fold lines separating the back panels from the side panels 18, 20 until the back panels are generally perpendicular with the side panels. As such, the longitudinal edges of the back panels 22, 24 are secured together, via glue, adhesive, or other method of securement. With the back panels 22, 24 secured together, the base 12 of the rack display 10 is in its erected configuration (i.e., FIG. 4) and capable of being self-supported on a ground surface. As previously mentioned, in certain embodiments, the base 12 additionally includes bottom tabs 32 extending from bottom edges of one or more of the panels. In such embodiments, the bottom tabs are folded until the tabs are perpendicular with the panels, such that the bottom tabs are operable to provide additional support and stability of the base 12 as it is positioned on the ground surface.

Figure 5:
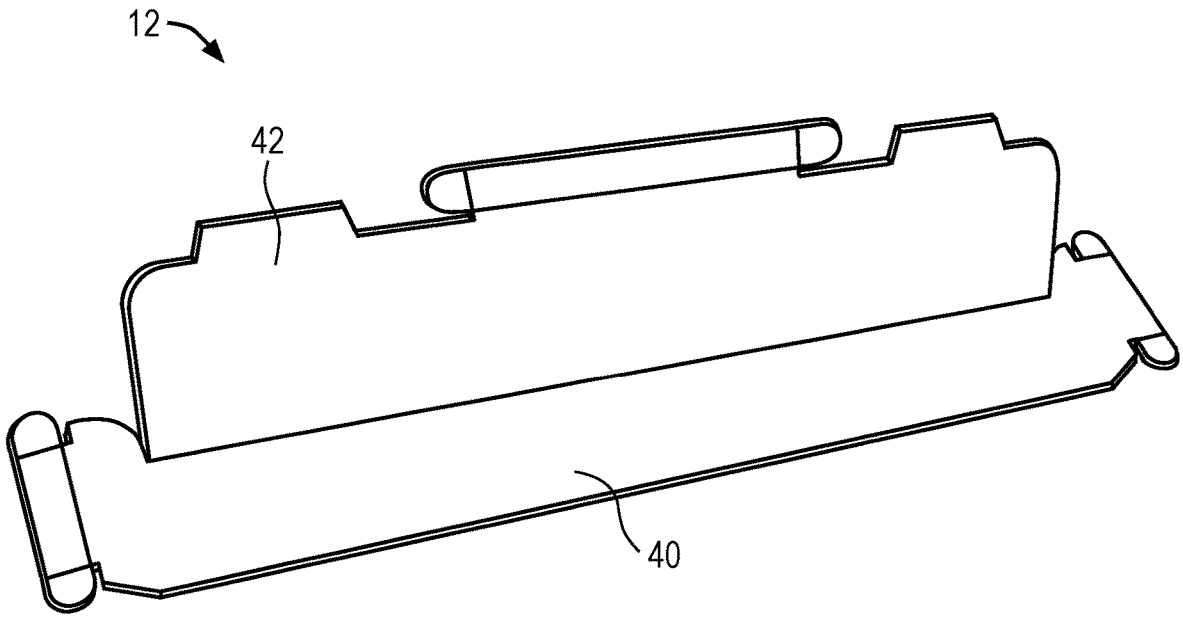
FIG. 5 is a perspective view of the shelf member from FIG. 3, with the shelf member partially folded in an erect configuration.
Figure 6:
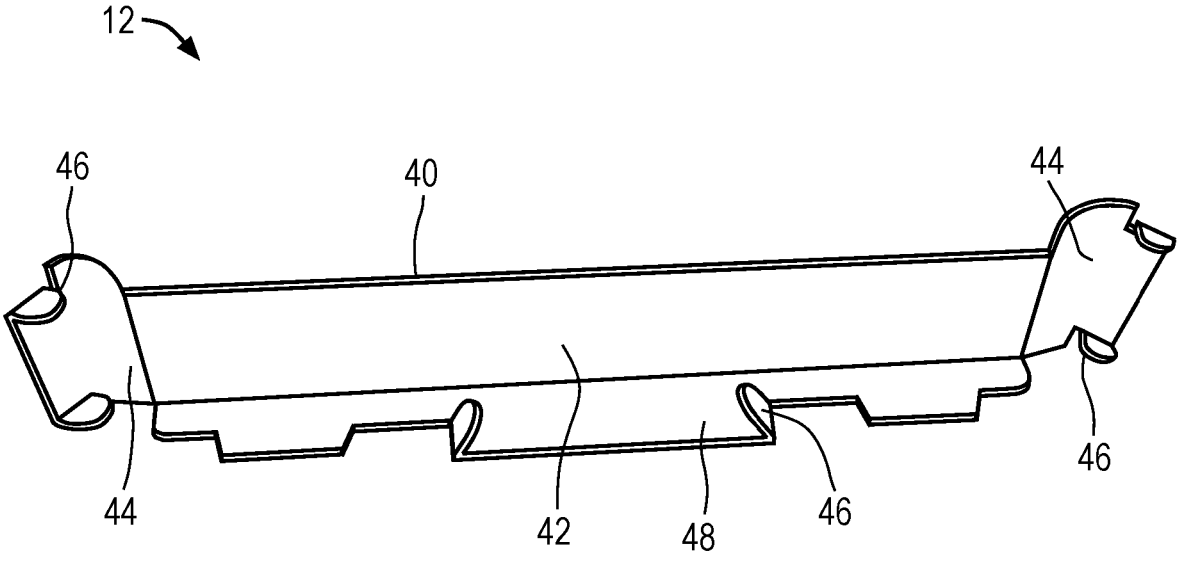
FIG. 6 is a perspective view of the shelf member from FIGS. 3 and 5, with the shelf member completely folded in the erect configuration.

Once the base 12 has been erected, the shelf members 14 are converted from their knockdown configuration to their erected configuration, where they are then secured to the base. To begin, as illustrated by FIG. 5, each shelf member 14 is erected by initially folding the inner panel 42 about the fold line separating it from the outer panel 40 until the inner panel and the outer panel are folded together. With the inner panel 42 and outer panel 40 folded together, as illustrated by FIG. 6, the panels are secured together by glue or other adhesive. In some embodiments, the outer and inner panels 40, 42 are glued together during manufacture of the rack display 10. In other embodiments, the outer and inner panels 40,42 are glued together during assembly of the rack display 10. Being secured together as such, the outer and inner panels 40, 42 form a main lip of the shelf member 14. In some embodiments, the outer and inner panels 40, 42 are formed from corrugated material (i.e., material comprising ridges and troughs). In such embodiments, when the outer and inner panels 40, 42 are folded and secured together, the ridges and troughs are misaligned, thus presenting a cross-corrugated main lip. Having a main lip comprising two pieces of corrugated material, or further comprising cross-corrugated pieces of material, increases and reinforces the strength of the shelf member 14, such that the shelf member is operable to securely hold heavy items.

Next, the side panels 44 are folded about the fold separating the side panels from the outer panel 40, until the side panels are generally perpendicular with the outer panel and the inner panel 42. Similarly, the tab panel 48 is folded about the fold line separating the tab panel from the inner panel 42, until the tab panel is generally perpendicular with the inner panel and the outer panel 40. Finally, the tab fingers 46 on the tabs of the side panels 44 and the tab panel 48 are folded against the tabs. In such an erected position, the shelf members 14 are configured for insertion and/or securement to the base 12 of the rack display 10.

Figure 7:
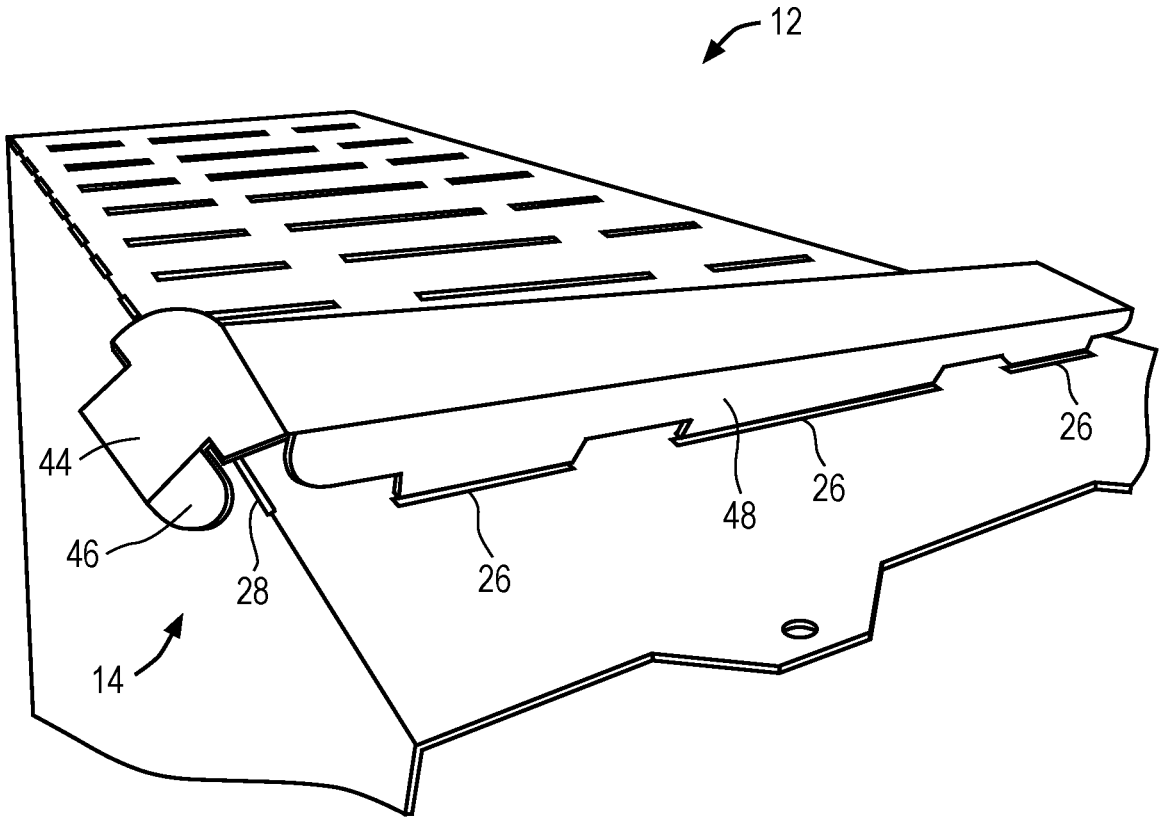
FIG. 7 is a bottom partial perspective view of the shelf member from FIGS. 3, 5, and 6 being coupled with the base from FIGS. 2 and 4.
Figure 8:
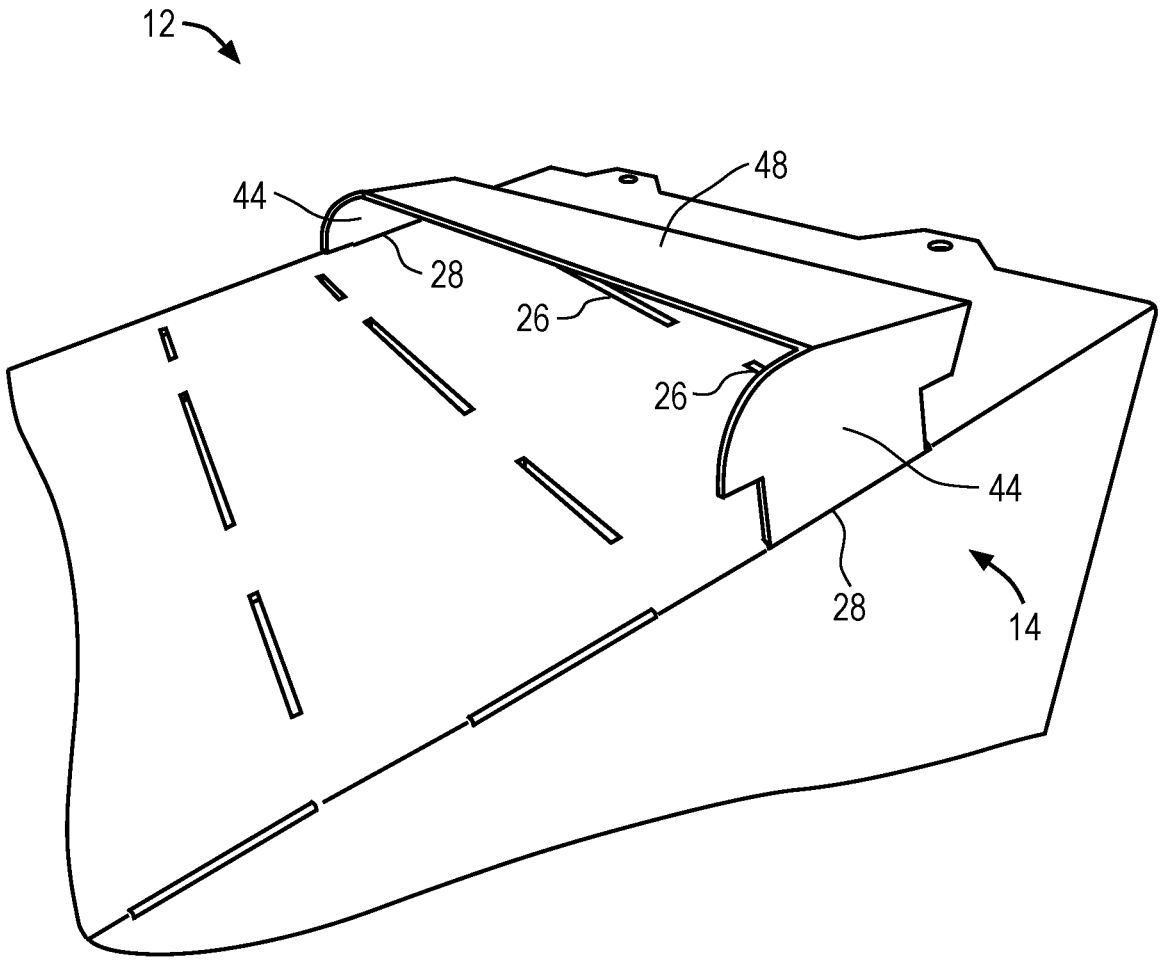
FIG. 8 is a top partial perspective view of the shelf member from FIGS. 3, 5, 6, and 7 being coupled with the base from FIGS. 2, 4, and 7.

In particular, as illustrated by FIGS. 7-8, tabs of the tab panel 48 of the shelf members 14 are inserted within the horizontal slots 26 of the row of horizontal slots on the front panel 16 of the base 12. Additionally, the tabs of the side panels 44 are inserted within the vertical slots 28 that are adjacent to the row of horizontal slots in which the tabs of the tab panel 48 were inserted. Subsequently, the tab fingers 46 are unfolded to their original position, such that the tab fingers retain the tabs within the horizontal and vertical slots 26, 28 so as to restrict removal of the shelf member 14 from the base 12. It will be appreciate that in other embodiments other tabs of the shelf member 14 include tab fingers 46 as well, and in still other embodiments, varying arrangements of tabs with and without tab fingers are utilized.

Figure 9:
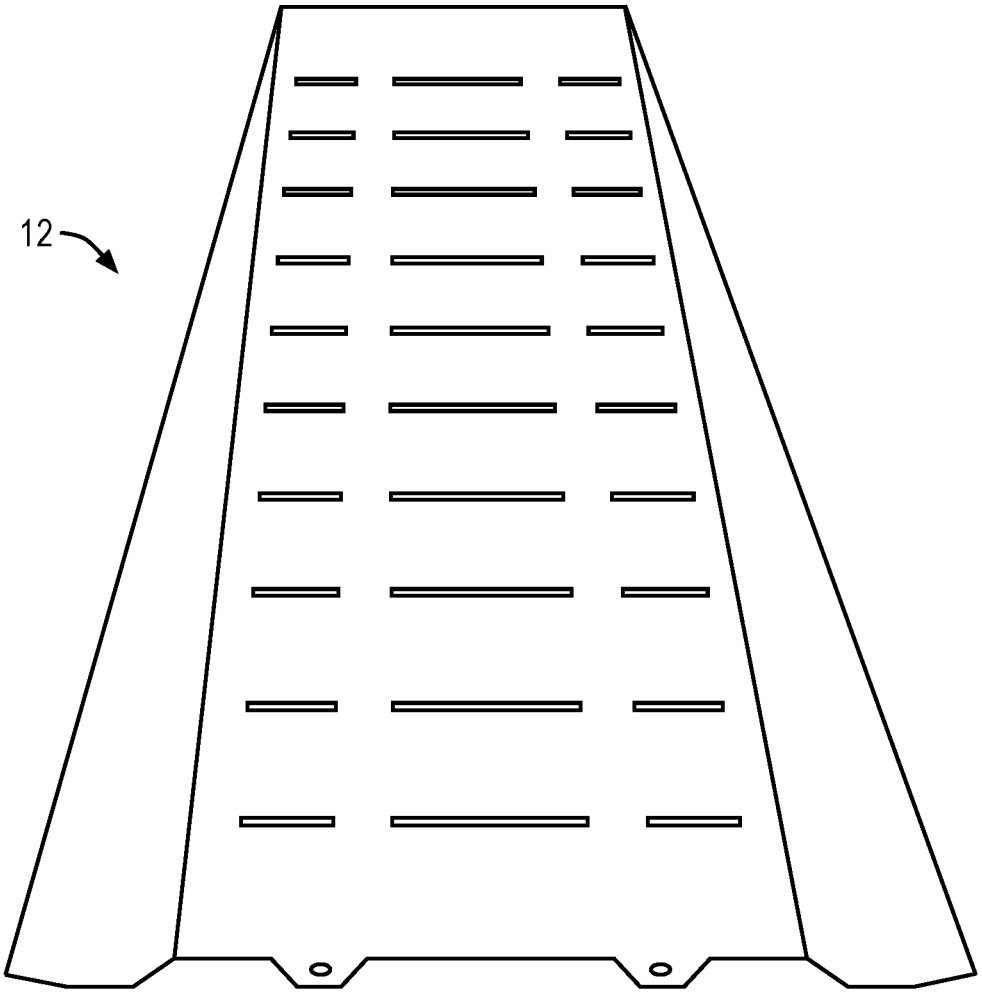
FIG. 9 is a perspective view of the base from FIG. 2 in a semi-knockdown configuration according to embodiments of the present invention.

With the shelf members 14 secured to the base 12, the rack display 10 is in its erected configuration, such as shown in FIG. 1. As such the rack display is capable of being utilized to hold and display various products, such as cards, magazines, books, or the like. To transform the rack display 10 from its erected configuration to its knockdown configuration, a user performs the steps described above in reverse order. In addition, however, as previously described, embodiments provide for the rack display 10 to include fold lines that longitudinally bisect the left and right side panels 18, 20. As such, from an erected configuration, the left and right side panels 18, 20 are capable of being folded about the bisecting fold lines, such that the base 12 collapses until the front panel 16 is folded upon the back panels 22, 24. Such a semi-knockdown configuration, as is illustrated in FIG. 9, provides for an efficient way to configure the rack display 10 in a two-dimensional arrangement from its erected configuration (i.e., FIG. 1) to facilitate storage and/or transport.

Although the invention has been described with reference to the embodiments illustrated in the attached drawing figures, it is noted that equivalents may be employed and substitutions made herein without departing from the scope of the invention as recited in the claims.

What is claimed is:

1. A rack display comprising:

a base defining a plurality of slots; and a plurality of shelf members, each shelf member being moveable between an engaged configuration coupled to said base and a disengaged configuration displaced from said base, wherein a first shelf member of said plurality of shelf members comprises:

a first panel hingedly coupled to a second panel, the first panel being generally horizontal and the second panel being generally vertical;

side panels hingedly coupled to opposed ends of said second panel; and a vertical tab extending from a distal end of each of said side panels, wherein vertical slots of said plurality of slots of said base are configured to receive respective vertical tabs of said first shelf member as said first shelf member is moved towards its engaged configuration, wherein said second panel comprises an outer panel and an inner panel, said inner panel extending approximately vertically downward from a top edge of said outer panel towards a bottom edge of said outer panel, and wherein said base, said first panel, said inner panel, and said side panels define a pocket when said first shelf member is in an engaged configuration.

2. The rack display of claim 1, wherein said first shelf member comprises a plurality of horizontal tabs, horizontal slots of said plurality of slots of said base being configured to receive respective horizontal tabs of said first shelf member as said first shelf member is moved towards its engaged configuration.

3. The rack display of claim 1, wherein said side panels extend from said outer panel.

4. The rack display of claim 1, wherein said base comprises a support tab that is operable to facilitate stability of said base.

5. The rack display of claim 1, wherein said outer panel is secured via an adhesive to said inner panel.

6. The rack display of claim 1, wherein said first shelf member comprises three horizontal tabs and two vertical tabs.

7. The rack display of claim 1, wherein said base comprises opposed front and back panels and defines an interior area therebetween, said back panel defining an opening operable to provide access to said interior area.

8. The rack display of claim 7, wherein said base comprises opposed left and right side panels extending between opposed front and back panels, wherein each side panel of the base is longitudinally bisected by a fold line such that said base is operable to be folded between a deployed configuration and a knockdown configuration.

9. A rack display comprising:

a base defining a plurality of slots, a front surface of said base being defined by a first plane; and a plurality of shelf members, each shelf member being moveable between an engaged configuration coupled to said base and a disengaged configuration displaced from said base, wherein first and second shelf members of said plurality of shelf members each comprise:

a first panel extending away from said front surface of said base when the respective shelf member is in its engaged configuration, a top surface of said first panel being defined by a second plane;

a second panel extending approximately vertically upward from a distal end of said first panel, an inner surface of said second panel being defined by a third plane and an outer surface of said second panel being defined by a fourth plane; and opposed left and right side panels, each side panel being hingedly coupled to a respective left and right side of said second panel, a vertical tab extending from a distal end of the left and right side panels, wherein each said vertical tab includes tab fingers extending from opposed sides of each vertical tab, wherein said tab fingers are capable of being folded and unfolded with respect to said vertical tabs, wherein said vertical tabs with tab fingers in a folded state are configured to be received by vertical slots of said plurality of slots of said base as the respective shelf member is moved towards its engaged configuration, wherein said first shelf member is secured to said base in a first position and said second shelf member is secured to said base in a second position above said first position, wherein the third plane of said first shelf member defines an exterior surface of a first pocket, said exterior surface being displaced from said base, wherein said fourth plane of said second shelf member extends into said first pocket, and wherein said second panel of said first shelf member comprises inner and outer panels, said inner panel extending approximately vertically downward from a top edge of said outer panel towards a bottom edge of said outer panel.

10. The rack display of claim 9, wherein said first shelf member comprises a horizontal tab that is configured to be received by a respective horizontal slot of said plurality of slots of said base as said first shelf member is moved towards its engaged configuration.

11. The rack assembly of claim 9, wherein respective distal ends of said side panels of said first shelf member are angled to approximately match a slope of a front panel of said base such that said second panel of said first shelf member remains approximately vertical when said first shelf member is secured to said base.

12. The rack assembly of claim 11, wherein said fourth plane of said second shelf member defines at least part of a back surface associated with said first pocket.

13. The rack assembly of claim 11, wherein said first plane intersects said second plane of said first shelf member at a back edge of a bottom surface of said first pocket.

14. The rack assembly of claim 9, wherein said fourth plane of said second shelf member defines at least part of a back surface associated with said first pocket.

15. The rack assembly of claim 14, wherein said first plane intersects said second plane of said first shelf member at a back edge of a bottom surface of said first pocket.

16. The rack assembly of claim 9, wherein said first plane intersects said second plane of said first shelf member at a back edge of a bottom surface of said first pocket.

* * * * *